US008711192B2

(12) United States Patent
Saito

(10) Patent No.: US 8,711,192 B2
(45) Date of Patent: Apr. 29, 2014

(54) IMAGE DECOLORIZING DEVICE

(71) Applicant: Toshiba Tec Kabushiki Kaisha, Tokyo (JP)

(72) Inventor: Yuichi Saito, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/794,403

(22) Filed: Mar. 11, 2013

(65) Prior Publication Data

US 2013/0242022 A1 Sep. 19, 2013

Related U.S. Application Data

(60) Provisional application No. 61/612,224, filed on Mar. 16, 2012.

(51) Int. Cl.
*B41J 2/325* (2006.01)

(52) U.S. Cl.
USPC ..... 347/179

(58) Field of Classification Search
USPC ..... 347/171, 179; 400/82, 188
See application file for complete search history.

(56) References Cited

U.S. PATENT DOCUMENTS

| | | | | |
|---|---|---|---|---|
| 2011/0050831 | A1* | 3/2011 | Yamada | 347/215 |
| 2012/0127255 | A1* | 5/2012 | Giese | 347/215 |
| 2013/0002782 | A1* | 1/2013 | Kawaguchi et al. | 347/179 |

FOREIGN PATENT DOCUMENTS

| | | |
|---|---|---|
| JP | 06-171226 | 6/1994 |
| JP | 2002-337368 | 11/2002 |
| JP | 2003-094696 | 4/2003 |
| JP | 2006-078867 | 3/2006 |

OTHER PUBLICATIONS

U.S. Appl. No. 13/484,195, Takahiro Kawaguchi et al., filed May 30, 2012, 50 pages.

* cited by examiner

*Primary Examiner* — Huan Tran
(74) *Attorney, Agent, or Firm* — Patterson & Sheridan, LLP

(57) ABSTRACT

According to embodiments, the image decolorizing device has a first heating conveying unit, a second heating conveying unit, and a guide. The first heating conveying unit has a first heating member that heats a first surface of the sheet and a first pressure member that presses the sheet to the first heating member. The second heating conveying unit has a second heating member that heats the second surface of the sheet and a second pressure member that presses the sheet to the second heating member. The guide is provided between the first heating conveying unit and the second heating conveying unit and that guides the sheet that is conveyed through the first heating conveying unit, to the second heating member of the second heating conveying unit.

20 Claims, 3 Drawing Sheets

IMAGE DECOLORIZING DEVICE

CROSS-REFERENCE TO RELATED APPLICATION

This application is based upon and claims the benefit of priority from U.S. Provisional Patent Application No. 61/612,224 filed on Mar. 16, 2012; the entire contents of which are incorporated herein by reference.

FIELD

Embodiments described herein relate to an image decolorizing device.

BACKGROUND

A conventional image decolorizing device decolorizes the color of a color material formed on a sheet by applying heat to the sheet, to thereby render a printed image on the paper, i.e., the color material, relatively invisible to the human eye. The color of the color material is generally decolorized at or above a predefined temperature.

To decolorize the color of a color material formed on both sides of the sheet, the image decolorizing device includes two pairs of rollers, each pair including a heating roller and a press roller, which are disposed to receive the printed material sheet therethrough for decolorization thereof. In each pair of the rollers, the press roller presses the sheet to the heating roller, and the heating roller heats the sheet. First, when the sheet passes through and between the first pair of a heating roller and a press roller, the color of the color material on one side of the sheet is decolorized. Next, when the sheet passes through and between the second of the pairs of a heating roller and a press roller, which is disposed downstream of the first pair, the other side of the sheet is decolorized.

In such an image decolorizing device, when the sheet passes between the first pair of the rollers and the second pair of the rollers, a jam of the sheet may occur.

DETAILED DESCRIPTION

In general, according to one embodiment, reference will now be made in detail to the present embodiment of the disclosure, an example of which is illustrated in the accompanying drawings. The accompanying drawings, which are incorporated in and constitute a part of this specification, illustrate an embodiment of the invention; together with the description, they serve to explain the principles of the disclosure.

Figure 4:
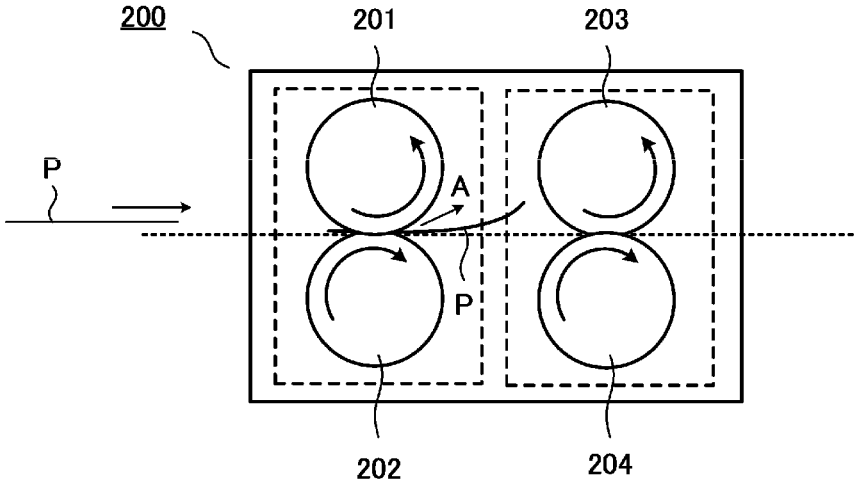
FIG. 4 is a main part block diagram of a conventional decolorizing unit.

The image decolorizing device of the present embodiment has a first heating conveying unit, a second heating conveying unit, and a guide. The first heating conveying unit has a first heating member that heats a sheet to decolorize a color of a color material formed on a first surface of the sheet and a first pressure member that presses the sheet to the first heating member. The second heating conveying unit has a second heating member that heats the sheet to decolorize a color of a color material formed on a second surface of the sheet and a second pressure member that presses the sheet to the second heating member. A guide is provided between the first heating conveying unit and the second heating conveying unit to guide the sheet that is conveyed through the first heating conveying unit to the second heating member of the second heating conveying unit. FIG. 4 is a main part block diagram of an erasing unit 200 that is built into an image decolorizing device. As shown in FIG. 4, generally, a sheet P that is heated by a pressure and heat region (the nip part) of a heating roller 201 and a pressure roller 202 curls in the direction along the heating roller 201 (arrow A) after the sheet P comes out from the pressure and heat region part. The sheet P that curls in this way is transported downstream, i.e., in the direction of the second pressure and heat region, and can contact a pressure roller 203 head on, i.e., the edge of the paper can strike the pressure roller along the circumference of the pressure roller 203, rather than move into the nip region between the pressure roller 203 and heating roller 204. The pressure roller 203 generally has a higher surface-friction than the heating roller 204, and the, and the sheet P having the curl may be crinkled, bent, misaligned or compressed, and once the movement of the pressure roller 203 brings the paper to the nip location, a jam may occur.

On the other hand, in the present embodiment, a guide is provided to guide the sheet P to the side of the pressure roller, rather than the heating roller, when the sheet enters to the pressure and heat region of the rollers that are provided downstream of the guide. Because the sheet P is guided by the heating roller, which has a lower surface-friction drag than the pressure roller, a jam of the sheet is prevented.

Below, the embodiments are described with reference to the figures. Additionally, in the case that the same reference symbols are used in the descriptions below, the same reference symbols mean that they have substantially the same configuration and function.

Figure 1:
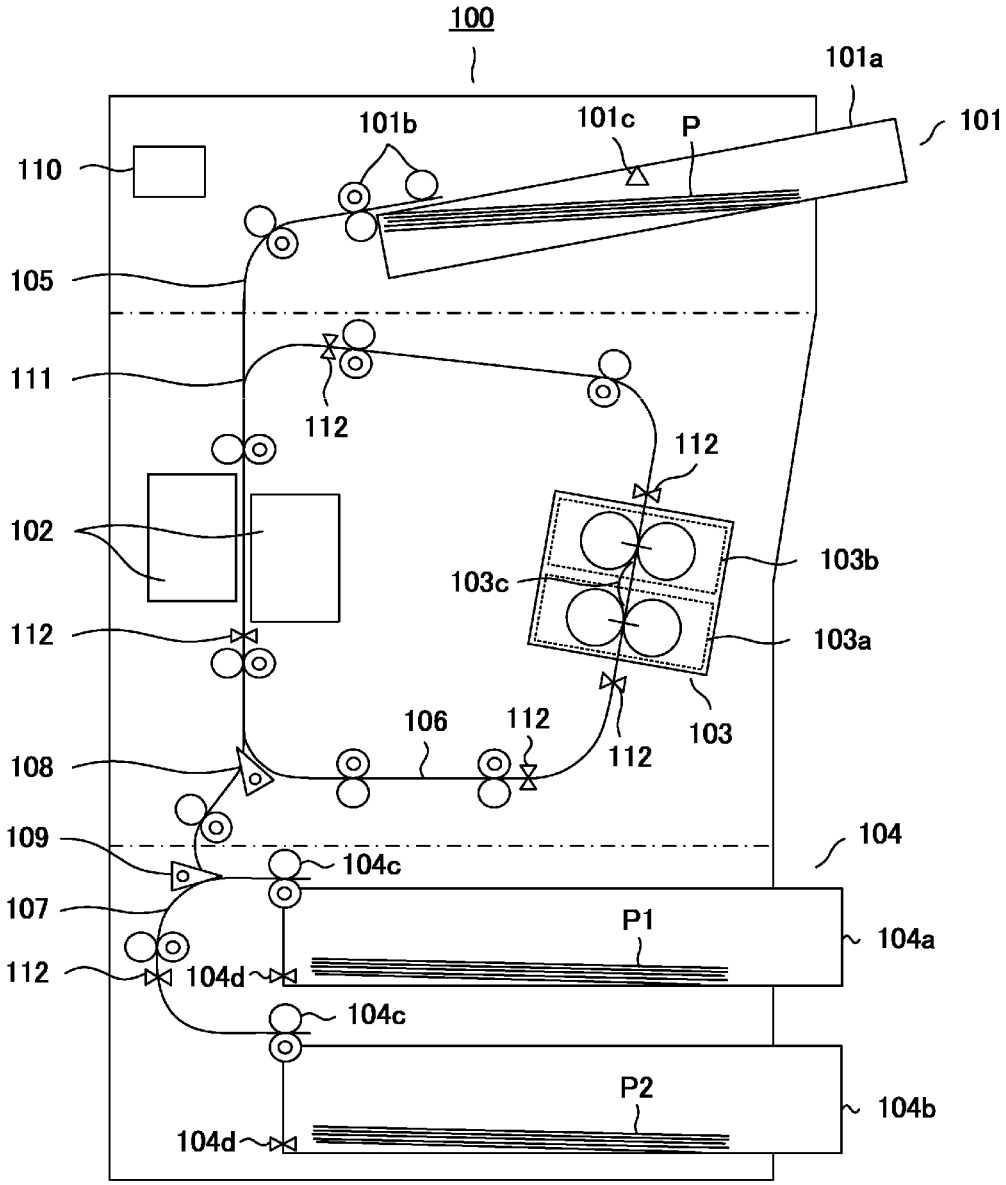
FIG. 1 is a schematic block diagram of the image decolorizing device according to a present embodiment.

FIG. 1 is a schematic diagram that shows the overall configuration of an image decolorizing device according to the present embodiment. An image decolorizing device 100 conducts a decolorization step that erases the color of a color material on a sheet P, which is a recording medium on which an image is formed using the color material. The color material can be decolorized, because it is comprised of materials, such as decolorizable toners and decolorizable inks. The image decolorizing device 100 includes a sheet feed unit 101, a readout unit 102, a decolorizing unit 103, a sheet receiving unit 104, a first conveyance path 105, a second conveyance path 106, a third conveyance path 107, a first branching member 108, a second branching member 109, and a control unit 110.

The sheet feed unit 101 includes a sheet feed tray 101*a* and a sheet feed member 101*b*. The sheet feed tray 101*a* holds the sheet P to be discolored. The sheet feed tray 101*a* holds variously sized sheets, such as A4, A3, and B5. The sheet P that the sheet feed tray 101*a* holds is, for example, a sheet on which an image is formed from a recording material that can be decolorized by heating the sheet over a predefined temperature. The sheet feed member 101*b* comprises a pick up roller, a sheet supply roller, and a separator roller that is positioned opposing the sheet supply roller, etc. and supplies the sheets P held on the sheet feed tray 101*a* to the first conveyance path 105, which is disposed the inside of the image decolorizing device 100, by one sheet at a time. In addition, the sheet feed tray 101*a* has a detecting sensor 101*c* that detects the presence/absence of the sheet P on the sheet feed tray 101*a*. The detecting sensor 101*c* can be, for example, a microsensor or a microactuator.

The readout unit 102 is disposed along the first conveyance path 105, which is located downstream of the sheet feed direction with respect to the sheet feed tray 101*a*. The readout unit 102 has a readout unit such as a CCD (Charge Coupled Device) scanner or a CMOS sensor, etc. The readout unit 102 reads out the image from both sides (a first surface and a second surface) of the transported sheet P. That is, the readout unit 102 includes two readout subunits that are sandwiching the first conveyance path 105. Because the two readout subunits are disposed at both sides of the first conveyance path 105, the two readout subunits can read or detect images on both surfaces of the transported sheet P. The image that the readout unit 102 reads out is stored in a memory that is included in the control unit 110. For example, if the data of the image that will be decolorized will be needed later, the image on the sheet is read out by the readout unit 102 and the data of the image is stored in the memory by digitizing the image so that it can retrieved from the memory, before the image is decolorized. Further, the control unit 110 determines whether or not the sheet is a decolorizable sheet and whether or not the sheet is a reusable sheet, based on the image that the read out unit 102 reads out.

In the downstream direction of the readout unit 102, a first branching member 108, which functions as a paper path switching unit is disposed. The first branching member 108 switches the feeding direction of the sheet that has passed through the readout unit 102. The first branching member 108 guides the sheet that is conveyed through the first conveyance path 105 to the sheet receiving unit 104 or to the second conveyance path 106. The second conveyance path 106 branches from the first conveyance path 105 at the branching point at which the first branching member 108 is disposed. The second conveyance path 106 that branches from the branching point guides the sheet P to the decolorizing unit 103. The selection of the path 106 or continued movement of the sheet to sheet receiving unit 104 is determined by a signal from the readout unit: Where the sheet has an image, the signal from the read out unit 102 causes the controller of the system to switch (or maintain the position of, if already switched) the branching member 108 to guide the sheet P to the second conveyance path 106. If no signal indicative of an image on the paper is sent from the readout unit 102, the switch will be positioned to send the sheet to the sheet receiving unit 104.

The decolorizing unit 103 located on the second conveyance path 106 erases (decolorizes) the color material on the sheet P passing therethrough. The decolorizing unit 103 decolorizes the color material by, in a state where the decolorizing unit is in contact with the sheet P, heating the sheet P to a predefined decolorizing temperature. The decolorizing unit 103 can carry out the decolorizing step on both sides of the sheet P.

The decolorizing unit 103 includes a first heating conveying member 103*a* and a second heating conveying member 103*b*, which clamp and convey the sheet P, as well as a guide 103*c*. The first and the second heating conveying members 103*a* and 103*b* are disposed along the second conveyance path 106. One side (also referred to herein as the "first surface") of the sheet P is decolorized by heat from the first heating conveying member 103*a* while conveyed therethrough. The other side (also referred to herein as the "second surface") of the sheet P is decolorized by heat from the second heating conveying member 103*b*, which is disposed downstream of the first heating conveying member 103*a*, while being conveyed therethrough. The sheet P conveyed by the first heating conveying member 103*a* is guided by the guide 103*c* to the second heating conveying member 103*b*. Thus, the decolorizing unit 103 decolorizes the color of the color material on both surfaces of the sheet P while conveying it therethrough.

The sheet receiving unit 104 includes a first sheet receiving tray 104*a*, a second sheet receiving tray 104*b*, and a plurality of sheet receiving members 104*c*. The first sheet receiving tray 104*a* is disposed above the second sheet receiving tray 104*b*.

Both of the first sheet receiving tray 104*a* and the second sheet receiving tray 104*b* have a loaded sheet detection sensor 104*d*. The loaded sheet detection sensors 104*d* detect that the number of the sheets that are loaded in the first sheet receiving tray 104*a* and the second sheet receiving tray 104*b* has reached a load tolerance level, and, when the load tolerance is reached, signal the control unit 110. The loaded sheet detecting sensor 104*d* can be, for example, a microsensor or a microactuator.

The first sheet receiving tray 104*a*, for example, receives sheets P1 that have been decolorized and determined to be reusable. The second sheet receiving tray 104*b* receives sheets P2 that have been determined to be not reusable. The sheet ejecting members 104*c* eject the sheets P1 to the first sheet receiving tray 104*a* and eject the sheets P2 to the second sheet receiving tray 104*b*. The first sheet receiving tray 104*a* and the second sheet receiving tray 104*b* may have their function switched with one another. Thus, the first sheet receiving tray 104*a* may receive the non-reusable sheets P2 and the second sheet receiving tray 104*b* may receive reusable sheets P1. The setting for what kind of sheets each sheet receiving tray receives, i.e., the setting for the transport destination of the sheets based on reusability can be, for example, set by the control unit 110. By this setting, the second branching member 109 switches the conveyance path and guides the transported sheet to the first sheet receiving tray 104*a* or to the second sheet receiving tray 104*b*.

The first conveyance path 105 is a conveyance path that guides the sheet P from the sheet feed tray 101*a* to the second branching member 109 through the readout unit 102. The second branching member 109 is disposed at downstream of the first branching member 108 along the first conveyance path 105. The second branching member 109 guides the sheet that is conveyed from the first branching member 108 to the first sheet receiving tray 104*a* or to the second sheet receiving tray 104*b*. The third conveyance path 107 guides the sheet P2 to the second sheet receiving tray 104*b*.

The second conveyance path 106 converges with the first conveyance path 105 at a confluence 111 that is upstream of the readout unit 102 in the sheet conveyance direction. Thus, the second conveyance path 106 converges with the first conveyance path 105 at the confluence 111 between the sheet feed unit 101 and the readout unit 102. Therefore, the sheet P that passes the readout unit 102 along the first conveyance path 105 and the decolorizing unit 103 along the second conveyance path 106 can pass the readout unit 102 again. The image decolorizing device 100 can convey the sheet P that is supplied from the sheet feed unit 101 to the readout unit 102, the decolorizing unit 103, and the readout unit 102 in this order by controlling the first branching member 108 based on the image or no image status of the sheet.

The control unit 110 has a processor, including a CPU (Central Processing Unit) or an MPU (Micro Processing Unit), and a memory. The control unit 110 controls the overall steps that are carried out in the units of the image decolorizing device 100, such as the sheet feed unit 101, the readout unit 102, the decolorizing unit 103, and the sheet receiving unit 104, etc. The memory is, for example, a semiconductor memory and includes a ROM (Read Only Memory) that stores various controller programs and a RAM (Random Access Memory) that provides a temporary working space to the processors. For example, the ROM stores the printing ratio of a sheet that will be a threshold value to determine whether or not the sheet is reusable and a concentration threshold value to determine whether or not the image has been decolorized. The RAM can also temporarily store the data of the image that is read out at the readout unit 102.

The conveyance path of the sheet P is switched based on processing mode that is carried out by the image decolorizing device 100. Thus, the image decolorizing device 100 has a plurality of processing modes of operation. The processing modes include, for example, the following modes: (1) a first decolorizing mode in which image readout is not conducted and only the decolorizing step is carried out; (2) a second decolorizing mode in which the decolorizing step is conducted after reading out the image is performed; (3) a third decolorizing mode in which a readout step is not carried out before decolorizing and, after the decolorizing step, a segregation step of whether or not the sheet P can be reused (the segregation step); (4) a fourth decolorizing mode in which a reading out step is carried out before the decolorizing and a segregation step is carried out after the decolorizing step; and (5) a readout mode, in which the readout step of the image is carried out without carrying out image decolorization. Each of these modes can be selected at the operating panel (not shown in FIG. 1) of the image decolorizing device 100 or an external terminal. In the first through fourth decolorizing modes, the sheet P is always transported to the decolorizing unit 103. On the other hand, in the readout mode, the image decolorizing device 100 controls the first branching member 108 and, without transporting the sheet P to the decolorizing unit 103, the sheet P is ejected to the sheet receiving unit 104 after passing through the readout unit 102.

The image decolorizing device 100 has a plurality of sheet detection sensors 112 that detect the sheet that is transported through the first through the third conveyance paths 105, 106, and 107. The sheet detection sensors 112 can be, for example, microsensors or microactuators. The sheet detection sensors 112 are placed in appropriate locations on the conveyance paths.

Figure 2:
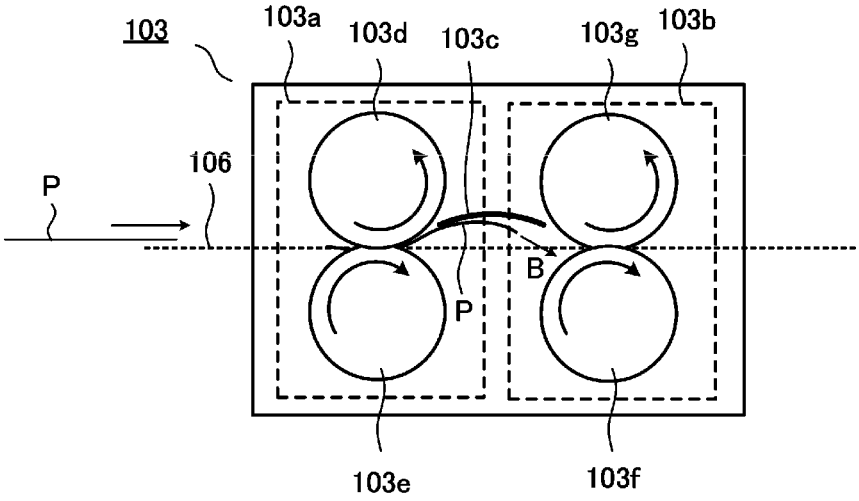
FIG. 2 is a main part block diagram of the erasing unit in FIG. 1.

FIG. 2 is a schematic side vies of the decolorizing unit 103. As shown in FIG. 2, the decolorizing unit 103 includes a first heating conveying member 103*a*, a second heating conveying member 103*b*, and a guide 103*c*. The first heating conveying member 103*a* includes a heating roller 103*d* and a pressure roller 103*e*. The heating roller 103*d* (a first heating member) heats the first surface of the sheet P that is conveyed to the decolorizing unit 103. The pressure roller (a first pressure member) 103*e* is disposed so that the pressure roller 103*e* presses the sheet P into contact with the heating roller 103*d*, and in conjunction with the heating roller conveys the sheet through the conveying member. The heat source of the heating roller 103*d* may be, for example, a halogen lamp, which is provided within the heating roller 103*d*. The first heating member 103*d* includes members that have a high degree of hardness and have a surface roughness that is lower than that of the first pressure member 103*e*. The sheet P has an image on the first surface of the sheet P, which is decolorized when the sheet is passed between the first heating roller 103*d* and the first pressure roller 103*e*, i.e., the pressure-welded part (the nip part) of the heating roller 103*d* and the first pressure member 103*e*.

The second heating conveying member 103*b* includes a heating roller 103*f* and a pressure roller 103*g*. The heating roller 103*f* (a second heating member) heats the second surface of the sheet P that is conveyed from the first heating conveying member 103*a*. The pressure roller 103*g* (a second pressure member) is disposed so that the second pressure roller 103*g* presses the sheet P to the heating roller 103*f* and in conjunction therewith moves the sheet through the second heating conveying member 103*b*. The second heating roller 103*f* is disposed opposite to the first heating roller 103*d* with respect to the sheet P passing therethrough. That is, the second heating roller 103*f* is disposed so that it contacts with the side of the sheet P opposite to the side with which the first heating roller 103*d* contacts. In addition, the second heating conveying member 103*b* is disposed downstream of the first heating conveying member 103*a* in the sheet conveyance direction. Further, the second heating conveying member 103*b* is provided in a location that is, for example, around 60 mm away from the first heating conveying member 103*a* in the sheet conveyance direction. That is, the space between the first heating conveying member 103*a* and the second heating conveying member 103*b* is around 60 mm. This space is provided so as to clamp the smallest-sized sheet at the same time in the first heating conveying member 103*a* and in the second heating conveying member 103*b*. The second heating member 103*f* includes members that have a high degree of hardness and have a surface roughness that is lower than that of the second pressure member 103*g*. The sheet P that passes through the first heating conveying member 103*a* has an image on the second surface of the sheet P, which is decolorized when it is passed between the second heating roller 103*f* and the second pressure roller 103*g*, i.e., the pressure-welded part (the nip part) of the second heating member 103*f* and the second pressure member 103*g*.

The guide 103*c* is disposed between the first heating conveying member 103*a* and the second heating conveying member 103*b*. The guide 103*c* has a curved shape that has a concaved surface facing the first side of the transported sheet P (i.e., a side on which the first heating roller 103*d* and the second pressure roller 103*g* are provided with respect to the second conveyance path 106. Because of this shape, the guide 103*c* guides the sheet P that is transported from the pressure-welded part of the first heating conveying member 103*a* toward the second heating roller 103*f* (i.e., below the second conveyance path in FIG. 2) when the sheet P enters the pressure-welded part of the second heating conveying member 103*b*. In the present embodiment, the second heating roller 103*f* includes materials with lower surface roughness compared to the second pressure roller 103*g*. Rollers with lesser surface roughness are less likely to cause a jam of the sheet P while conveying. Therefore, by guiding the sheet P to the side of the second heating roller 103*f*, the guide 103*c* is less likely to cause the jam of the sheet compared to a configuration in which the sheet P enters the nip region from the side of the second pressure roller 103*g*.

The guide 103*c* is preferably comprised of a material with good demolding properties and high heat resistance and this material is, for example, fluorine resin PFA (tetrafluoroethylene/perfluoroalkyl vinyl ether polymer), etc. A temperature sensor that detects a temperature at surface of a roller is provided, respectively, for the first heating roller 103*d* and the second heating roller 103*f*. The detected information at the sensors is output to the control unit 110. The control unit 110, based on the input information, controls a current supplying to the heat sources of the first and the second heating rollers 103*d* and 103*f*. The temperatures at the first and the second heating rollers 103*d* and 103*f* are controlled to be nearly the same. In the present embodiment, the guide 103*c* does not necessarily have to be configured so that the sheet P strikes the guide immediately after the sheet leaves the first heating conveying member 103*a*. For example, the guide 103*c* can be configured so that it guides the sheet P to a tangential direction at the end of the guide 103*c* that is closest to the second heating conveying member 103*b*. Such a configuration can prevent a jam of the sheet P in the second heating conveying member 103*b*.

Figure 3:
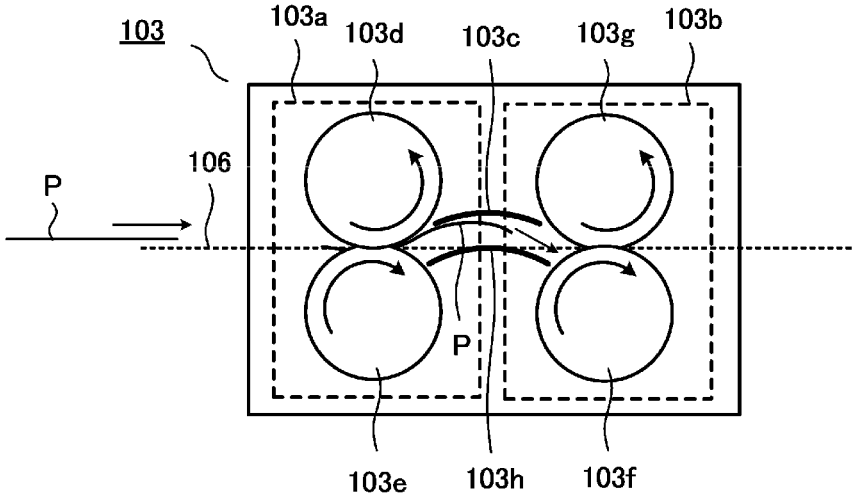
FIG. 3 is a main part block diagram of the decolorizing unit according to another embodiment.

Additionally, as shown in FIG. 3, a supplemental guide 103*h* may be provided to guide the sheet P from the second side of the sheet. The supplemental guide 103*h* is disposed nearly parallel with the guide 103*c*, i.e., having the same arc spaced to provide a constant distance therebetween. By providing a supplemental guide 103*h*, the transport of the sheet P can be regulated from both sides of the sheet, and the sheet P can more reliably enter the second heating conveying member 103*b* to the pressure and heating part from the side of the second heating roller 103*f*.

Meanwhile, the embodiment can also have a configuration in which the positions of the first and the second heating conveying members 103*a* and 103*b* in the decolorizing unit 103 are reversed with each other; i.e., the second heating conveying member 103*b* may be placed on the upstream side of the transported sheet P and the first heating conveying member 103*a* may be placed on the downstream side. In this case, the guide 103*c* is provided on the second surface side of the sheet P.

(Other Embodiments)

The embodiments of the heating members and the pressure members of the decolorizing unit 103 can be changed to the extent that the embodiment does not deviate from the present embodiment. For example, the first and the second heating members and/or the first and the second pressure members of the embodiment mentioned above may be configured as a roller engaged against and endless belt, or an endless belt engaged against another endless belt, etc. Also, the image decolorizing device of the present embodiment can be incorporated into an image forming device and constitute an image forming/decolorizing device.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image decolorizing device comprising:

a first heating conveying unit that has a first heating member that heats a sheet to decolorize a color of a color material formed on a first surface of the sheet and a first pressure member that presses the sheet to the first heating member;

a second heating conveying unit that has a second heating member that heats the sheet to decolorize a color of a color material formed on a second surface of the sheet and a second pressure member that presses a sheet to be passed therethrough against the second heating member; and a guide that is provided between the first heating conveying unit and the second heating conveying unit and positioned to guide a sheet to be conveyed through the first heating conveying unit, to the second heating member of the second heating conveying unit such that the sheet contacts the second heating member before contacting the second pressure member.

2. The image decolorizing device according to claim 1, wherein the guide has a curved shape that has a concaved surface facing the first surface of a sheet to be transported therepast.

3. The image decolorizing device according to claim 2, further comprising:

a supplemental guide that guides the sheet from the second surface of the sheet and that is formed nearly parallel to the guide.

4. The image decolorizing device according to claim 3, wherein the supplemental guide is made from fluorine resins.

5. The image decolorizing device according to claim 1, wherein the first and the second heating members are heating rollers.

6. The image decolorizing device according to claim 5, wherein the second heating roller is positioned to contact a sheet to be passed thereby on a side of the sheet opposite to the side with which the first heating roller will contact a sheet.

7. The image decolorizing device according to claim 5, wherein the first heating conveying unit and the second heating conveying unit are disposed so as to simultaneously clamp a sheet.

8. The image decolorizing device according to claim 1, wherein the guide is made from fluorine resins.

9. The image decolorizing device according to claim 1, wherein heat sources of the first and the second heating members are a halogen lamp.

10. The image decolorizing device according to claim 1, wherein the surface temperature of the first and the second heating members are controlled to be nearly the same temperature.

11. A method for decolorizing a color of a color material formed on a sheet comprising:

decolorizing the color of the color material formed on a first surface of the sheet by heating the sheet by a first heating member while the sheet is pressed to the first heating member by a first pressure member;

decolorizing the color of the color material formed on a second surface of the sheet by heating the sheet by a second heating member while the sheet is pressed to the second heating member by a second pressure member; and guiding the sheet, the first surface of which is decolorized by the first heating member, to the second heating member such that the sheet contacts the second heating member before contacting the second pressure member.

12. The method according to claim 11, wherein the sheet, the first surface of which is decolorized by the first heating member, is guided by a guide that has a curved shape that has a concaved surface facing the first surface of the sheet.

13. The method according to claim 12, wherein the sheet, the first surface of which is decolorized by the first heating member, is guided by a supplemental guide from the second surface of the sheet.

14. The method according to claim 11, wherein the color of the color material on the first surface of the sheet is decolorized by contacting with the first heating member, and the color of the color material on the second surface of the sheet is decolorized by contacting with the second heating member.

15. The method according to claim 11, further including simultaneously clamping a sheet with the first heating member and the first pressure member and with the second heating member and the second pressure member.

16. An image decolorizing device comprising:

a first heating conveying unit that has a first heating member that heats a sheet to decolorize a color of a color material formed on a first surface of the sheet and a first pressure member that presses the sheet to the first heating member;

a second heating conveying unit that has a second heating member that heats the sheet to decolorize a color of a color material formed on a second surface of the sheet and a second pressure member that presses the sheet to the second heating member; and a guide that is provided between the first heating conveying unit and the second heating conveying unit and that guides the sheet that is conveyed through the first heating conveying unit to, either the second heating member or the second pressure member that has lower surface-friction.

17. The image decolorizing device according to claim 16, wherein the guide has a curved shape that has a concaved surface facing the first surface of the sheet.

18. The image decolorizing device according to claim 17, further comprising:

a supplemental guide that guides the sheet from the second surface of the sheet and that is formed nearly parallel to the guide.

19. The image decolorizing device according to claim 16, wherein the second heating member is provided so that it contacts with the side of the sheet opposite to the side with which the first heating member contacts.

20. The image decolorizing device according to claim 16, wherein the first heating conveying member and the second heating conveying member are disposed so as to simultaneously clamp the sheet.

* * * * *